US005096365A

United States Patent [19]

Ford

[11] Patent Number: 5,096,365

[45] Date of Patent: Mar. 17, 1992

[54] APPARATUS AND METHOD FOR LIFTING, ROTATING, AND STACKING TRAILER CHASSIS

[75] Inventor: Jerry W. Ford, Tuscumbia, Ala.

[73] Assignee: Shoals American Industries, Inc., Muscle Shoals, Ala.

[21] Appl. No.: 602,780

[22] Filed: Oct. 24, 1990

[51] Int. Cl.[5] ..... B66F 9/18

[52] U.S. Cl. ..... 414/783; 414/791.3; 414/607; 414/620; 414/621; 414/786

[58] Field of Search ..... 414/607, 608, 621, 620, 414/772, 754, 783, 786, 678, 662, 724, 912, 791.3, 796.9

[56] References Cited

U.S. PATENT DOCUMENTS

| | | | |
|---|---|---|---|
| 3,448,880 | 6/1969 | Howard | 414/607 |
| 3,512,670 | 5/1970 | Howard | 414/607 |
| 3,589,540 | 6/1971 | Kinross | 414/608 |
| 3,670,903 | 6/1972 | Hamilton | 414/772 |
| 4,014,447 | 3/1977 | Whiteman et al. | 414/607 |
| 4,496,275 | 6/1985 | Harp | 414/754 X |
| 4,561,822 | 12/1985 | Schmook | 414/607 X |
| 4,583,902 | 4/1986 | Riley | 414/783 X |
| 4,600,350 | 7/1986 | Matthewson et al. | 414/783 X |
| 4,664,576 | 5/1987 | Coe | 414/791.3 |
| 4,796,029 | 1/1989 | Duppong | 414/772 X |

*Primary Examiner*—Robert J. Spar
*Assistant Examiner*—Brian K. Dinicola
*Attorney, Agent, or Firm*—Phillips & Beumer

[57] ABSTRACT

An apparatus and method for lifting, inverting, and stacking trailer chassis has a pair of support arms engageable with arms of a forklift vehicle and a frame pivotally mounted on outer ends of the support arms. The frame is mounted by engagement of pivot pins on the arm ends with apertures in side members of the frame, the apertures being located inwardly from the center of the length of the side members. This off-center placement of the axis of rotation of the frame enables it to be rotated when the forklift arms are raised without requiring power other than normal forklift lifting power. Clamps including a fixed L-shaped bracket and a cooperating slideable bracket are provided on the underside of the frame for engaging chassis beams of a trailer. A locking pin for securing the frame in a position generally coplanar with the support arms is also provided. In operation, the clamps are secured to a trailer chassis, and the forklift arms are raised while the forklift vehicle is propelled slightly forward to cause rotation of the trailer around a longitudinal axis.

11 Claims, 4 Drawing Sheets

APPARATUS AND METHOD FOR LIFTING, ROTATING, AND STACKING TRAILER CHASSIS

FIELD OF THE INVENTION

This invention relates generally to apparatus and methods for handling trailer chassis and more particularly to apparatus for lifting, rotating, and stacking trailers for storage.

BACKGROUND ART

The development of intermodal transportation has created a need for improved apparatus for handling of empty trailer chassis. In this method of transportation, cargo is shipped in large rectangular containers carried on ships, railroad flat cars, and on specially designed trailer chassis which are pulled over highways in the same manner as ordinary fixed body semitrailer vans. Containers are frequently delivered by truck to a rail yard or seaport where they are unloaded and transferred to a ship or train. It may be readily seen that large numbers of empty trailer chassis may become accumulated at such transfer sites, creating a storage space problem.

One approach to reducing the space required for storing empty trailer chassis has been to stack them on top of one another. This requires lifting the chassis off the ground, turning alternate ones of the chassis upside down to enable stacking, and moving them into position for stacking. These operations have been carried out by use of forklift vehicles with chains, but this approach is cumbersome, dangerous, and requires the coordinated efforts of several people.

A forklift attachable apparatus performing the required maneuvers for stacking trailer chassis is described in U.S. Pat. No. 4,664,576, issued May 12, 1987, to Coe. This apparatus uses a pair of pivotally mounted arms including fixed and movable jaws for grasping the chassis, the jaws being mounted on a rotatable carrier. Rotation of the carrier to invert a chassis by this apparatus requires application of hydraulic power in addition to the power normally supplied to forklift arms. Components required for the hydraulic system as well as required electrical controls and gears contribute greatly to the complexity and cost of this apparatus. While this apparatus provides an advantage in that grasping and releasing of a chassis may be carried out by actuation of switches without requiring an operator to manually connect clamps or the like, this benefit is realized only by inclusion of costly and complex features. An apparatus that provides effective and safe operation without requiring power to operate its grasping and rotating mechanisms or electrical components, gears, and the like to control these mechanisms would be highly desirable and would provide overall advantages even though a small amount of manual intervention on the part of the operator would be required.

SUMMARY OF THE INVENTION

The present invention is directed to apparatus attachable to the arms of a conventional forklift vehicle for grasping and lifting a trailer chassis, rotating the chassis about a horizontal axis parallel to the longitudinal axis of the chassis frame, whereby the chassis is turned upside down, lifting the inverted chassis and placing it in a stack between chassis placed right side up. A method including the steps required in achieving this result is also included in the invention. The apparatus includes a pair of horizontally disposed arms, each adapted at one end to receive and be secured to the arms of a forklift vehicle and at their other end having pivotal support means, a frame which may be an open rectangular structure made of I-beams, the frame being supported on the arms by the pivotal support means and arranged to be rotatable around an axis perpendicular to the support arms and spaced inward of the center of the length of side members of the frame. Means are provided on the frame for clamping it to supporting beams of a trailer chassis and for locking the frame in place upon completion of the desired rotation. Placement of the axis around which the frame rotates at an off-center location enables the chassis to be turned around the desired axis by force of gravity when the forklift arms are raised. No other source of power or electrical controls are required. The resulting simplified structure may be manufactured at a much lower cost than prior apparatus without loss of effectiveness or safety. Apparatus embodying the invention may be readily operated by a forklift driver, with only a minimum amount of time being needed for manual connection and release of clamps and a locking device.

It is, therefore, an object of this invention to provide apparatus for rotating trailer chassis about a horizontal longitudinal axis of rotation.

Another object is to provide apparatus for lifting, inverting, stacking, and unstacking of cargo container trailer chassis.

Yet another object is to provide such an apparatus that is attachable to a forklift vehicle and that requires no power for operation other than normal forklift lifting power.

Still another object is to provide a method of rotating trailer chassis about a longitudinal axis without use of a powered rotating means other than normal forklift power.

Other objects and advantages of the invention will be apparent from the following detailed description and the appended claims.

DESCRIPTION OF THE PREFERRED EMBODIMENT

Figure 1:
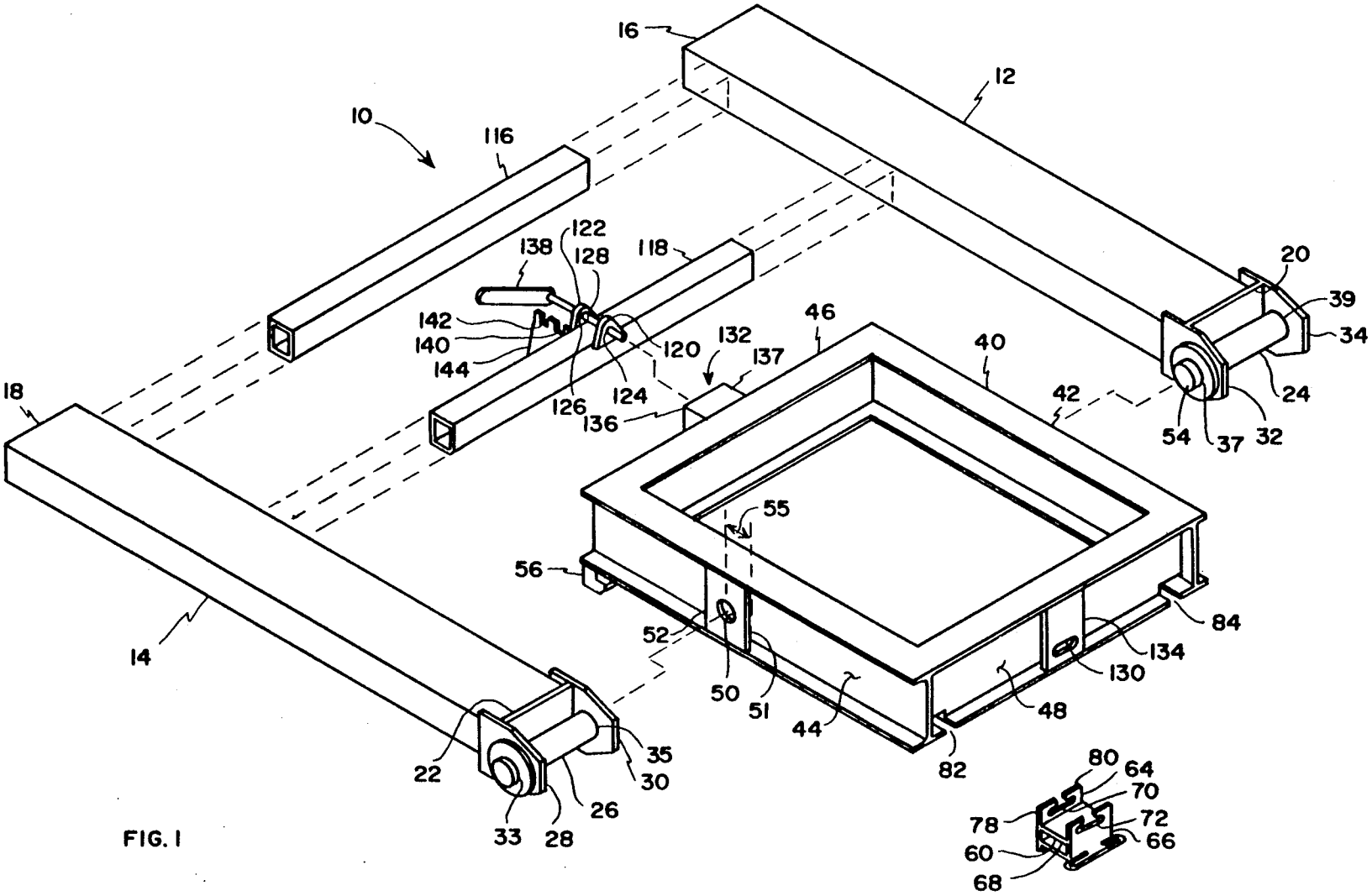
FIG. 1 is an exploded view showing a forklift-mountable apparatus embodying the invention.

Referring to FIG. 1 of the drawings, there is shown a forklift attachable apparatus 10 for lifting, inverting, and stacking trailer chassis. The apparatus includes a pair of support arms 12, 14 disposed in spaced-apart relation and adapted for being removably secured to arms of a forklift vehicle in horizontal position. The support arms, in the form of hollow rectangular tubing, are open at their inner ends 16, 18 such to be slidable into position onto arms of the forklift vehicle. Outer ends 20, 22 of the support arms have pivot pins 24, 26 secured thereto, the pins being disposed coaxially with respect to one another and transverse to the length of the support arms. The pivot pins are supported by vertically extending plates 28, 30 and 32, 34 welded to sides of the arms and apertures 33, 35 and 37, 39 for receiving the pins.

Figure 2:
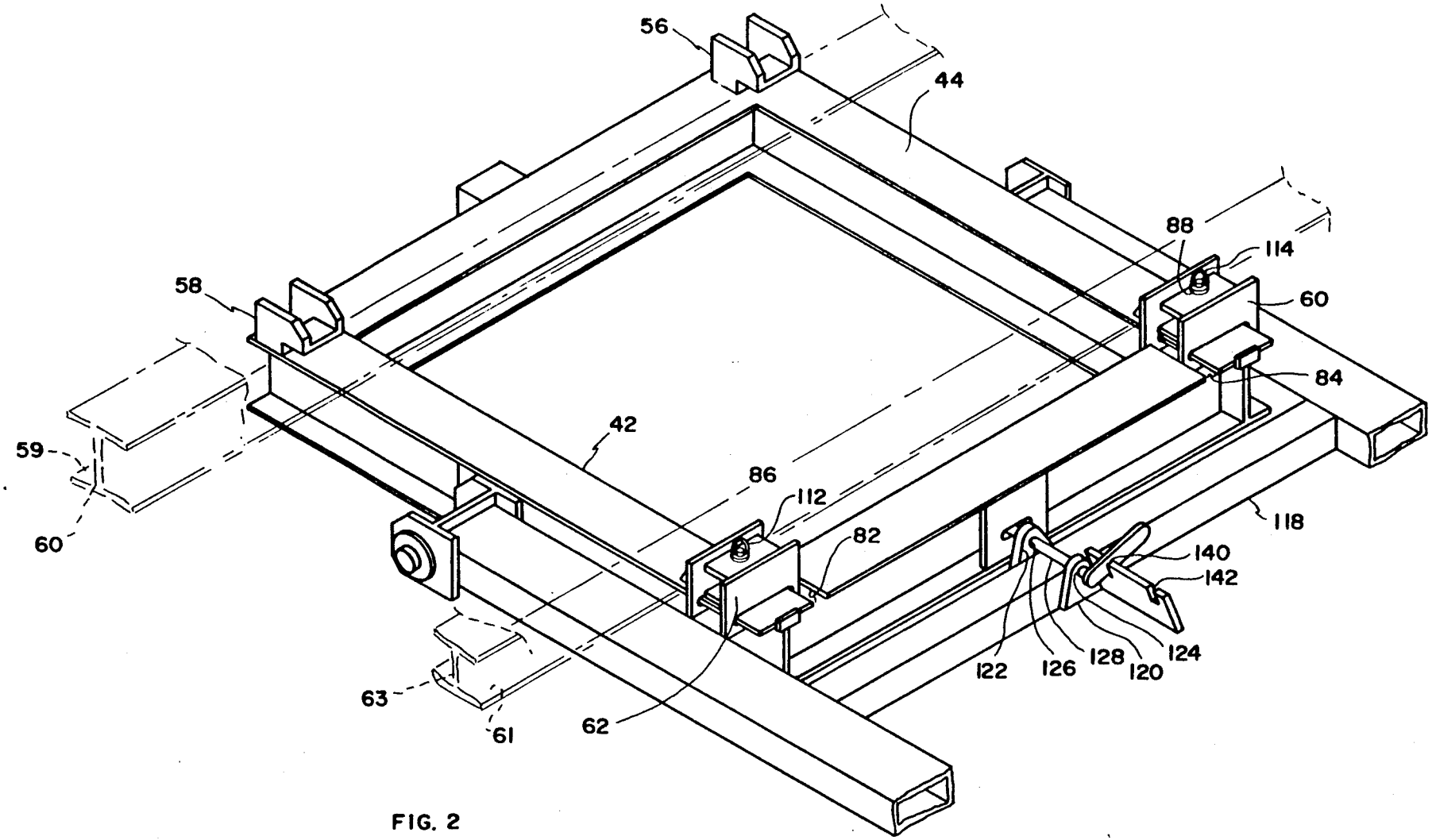
FIG. 2 is a pictorial view of the apparatus of FIG. 1 with the support frame rotated 180 degrees from the position shown in FIG. 1.
Figure 3:
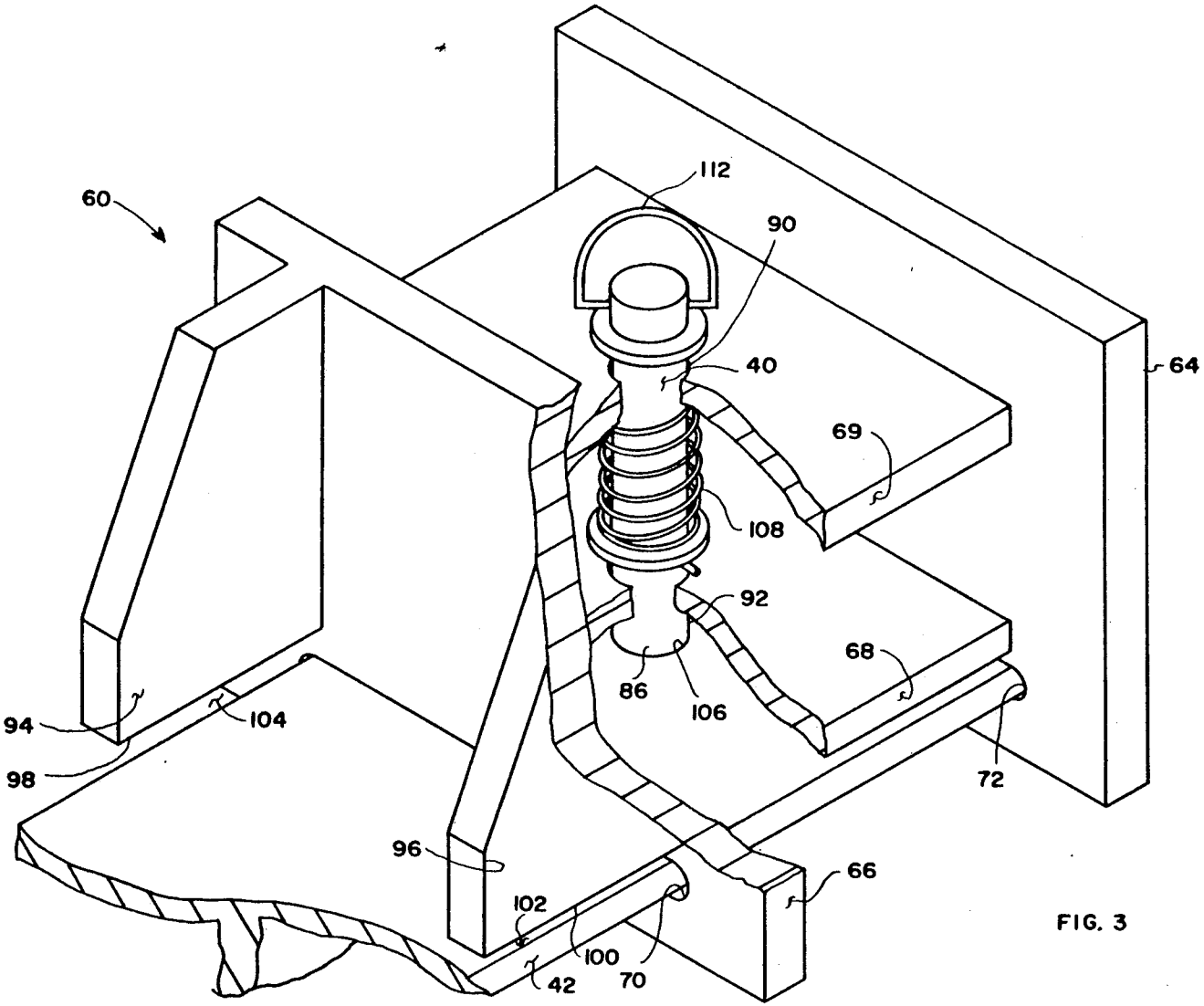
FIG. 3 is an enlarged pictorial view showing details of a clamp mechanism used to secure the apparatus to a trailer chassis.

Frame 40 and its attachment features are designed and sized for being secured to support members of a trailer chassis and in particular to a pair of longitudinally extending I-beams that have outwardly extended flanges on each side at their top and bottom. In the embodiment shown, the frame is made up of four I-beams comprising sides 42, 44 and ends 46, 48 welded together to form a rectangular structure with open space between the beams. Sides 42, 44 each have an aperture 50 in a vertical plate 52 secured to the outside of the I-beam and axially aligned with one another for receiving ends 54 of the pivot pins. The apertures are offset inwardly an increment of distance 55 so that when a trailer chassis is attached to the frame and the forklift arms are raised, the trailer will begin rotating downwardly around the pivot axis by force of gravity. As shown in FIGS. 1, 2, and 3, the frame at the inner and outer ends of sides 42, 44 is provided with mechanisms for clamping it to longitudinally extending I-beams of a trailer chassis. The inner ends, when the frame is disposed as shown in FIG. 1, have fixed L-shaped brackets 56, 58 located underneath the frame I-beams and arranged to engage and hook outside flange 59 of a trailer chassis I-beam. Opposite ends of the frame sides receive and support slidable clamps 60, 62 that ride on the bottom flanges of the side I-beams 42, 44 of the frame and are arranged to engage outside flange 61 of a second chassis I-bream 63, cooperating with brackets 56, 58 to secure frame 40 to the trailer chassis. The clamps have a pair of spaced apart, vertically extending plates 64, 66 (FIGS. 1 and 3), each having an opening 70, 72 underneath tabs 78, 80 for receiving and being slidably supported on side I-beams flanges 42, 44. Plates 64, 66 are connected by spaced apart horizontal plates 68 and 69 which have apertures 90, 92 for receiving spring biased pins 86, 88. Slots 82, 84 are provided in frame end 48 at its juncture with sides 42, 44 to enable sliding the clamp as required.

Clamp 60, 62 have secured on the inward facing side of the clamps a pair of end plates 94, 96 having a flat bottom surface 98, 100 parallel to the openings 70 and 72 defining a notch 102, 104 for engaging the I-beam flanges of a trailer chassis. Apertures 106 are provided in the top flanges of the side I-beams 42, 44 to receive spring biased pins 86 and 88 and thus secure the clamps in position. Pins 86, 88 are biased downward by springs 108, 110 and may be disengaged for sliding the clamps by pulling upward on handle 112, 114 at the top of the pins.

Arms 12 and 14 are secured to one another by cross member 116 connecting the arms at their inner ends and cross member 118 spaced apart from cross member 116 and positioned so as to enable locking of cross member 118 to the frame 40 in either its starting position or in fully rotated position. Cross member 118 is provided at the center of its length with upwardly extending tabs 120, 122 welded to its sides and having apertures 124, 126 defining an axis perpendicular to the tabs for insertion of a locking pin 128 that is slidably engageable with apertures 130, 132 in plates 134, 136 connected to outer edges of end I-beams 46, 48 of frame 40. End plate 136 is spaced apart from I-beam 46 by spacers 137 an increment corresponding to the off-center spacing of aperture 50 so as to enable locking of the pin and the aperture in the same manner at each end of the frame. Pin 128 has a radially extending handle 138 to enable manual grasping, and the handle is mateable with slots 140, 142 in plate 144 secured to the inner side of cross member 118, the slots being aligned parallel to handle 128 so as to allow the handle to be rotated into locking position therein.

Figure 4:
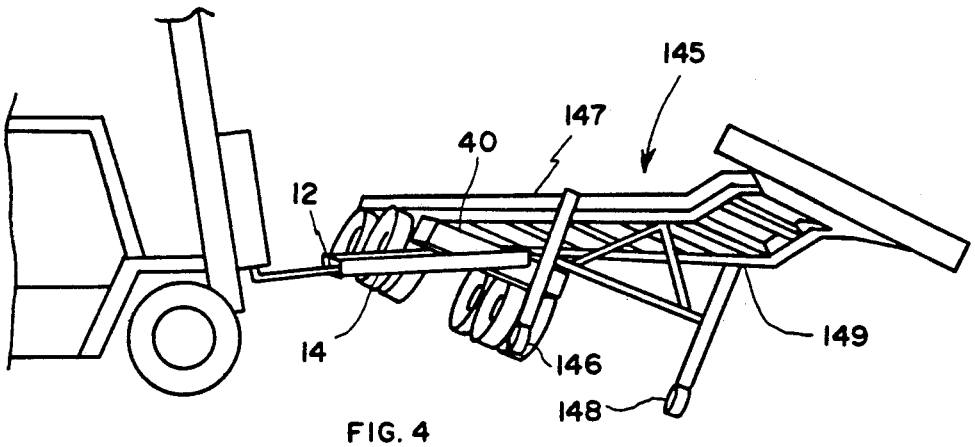
FIGS. 4, 5, and 6 are perspective views showing a trailer chassis in various stages of being rotated by the apparatus and method of the invention.
Figure 5:
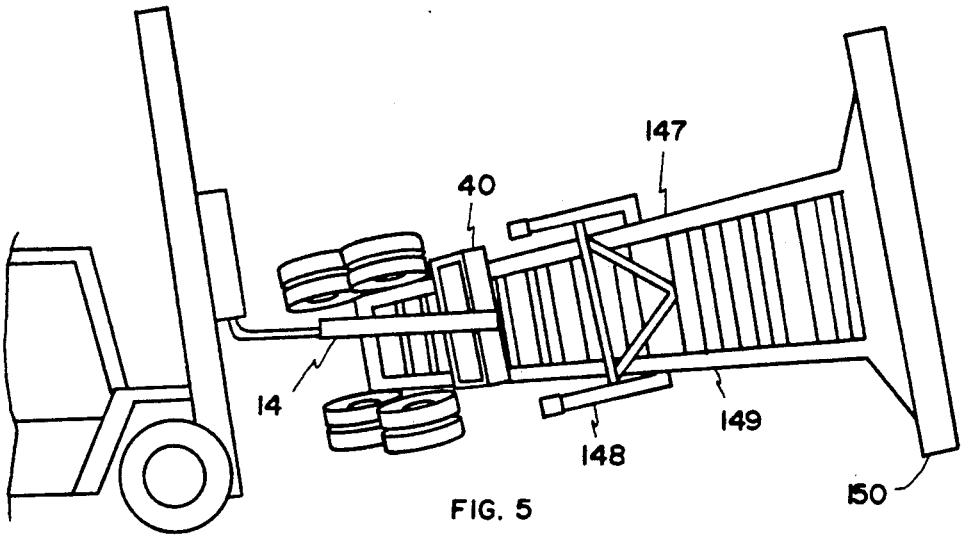
Figure 6:
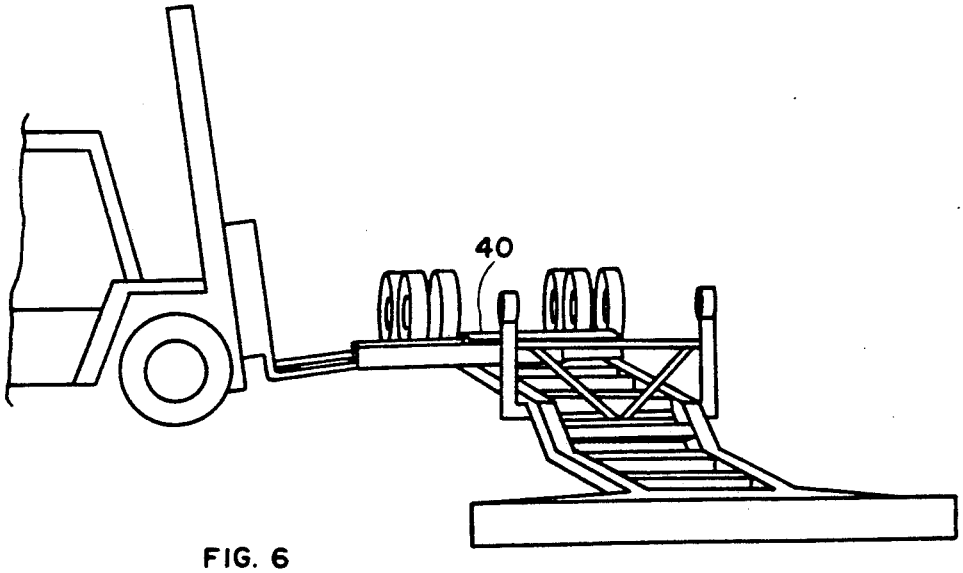

Operation of the apparatus and method of the invention is illustrated by FIGS. 4–6. FIG. 4 shows a container-type trailer chassis 145 being lifted and rotated around a horizontal axis. Frame 40 is fixedly secured on each side to an outside flange of a pair of chassis I-beams 147, 149 of the trailer, and in the view shown, the frame has been lifted up partially and its left side has remained down, thus beginning rotation around the pivot pins of support arms 12, 14. Owing to the offset location of frame 40 with respect to the axis of the pivot pins, the trailer is lifted along the side nearest the forklift, the opposite side remaining in contact with the ground by force of gravity at the bottom outer edge of tire 146 and at the bottom outer edge of jack leg 148. Clockwise rotation of the trailer around a line defined by parts of the chassis that are in contact with the ground requires that the forklift be driven slightly forward by the operator. Upon the forklift arms being lifted higher and moved further outwardly, the chassis is rotated to the position shown in FIG. 5 wherein leg 148 is lifted off the ground, and edge 150 of a front frame member of the chassis remains on the ground, providing along with tire edge 146 an axis around which chassis may be rotated once the chassis passes the vertical position. Completed inversion as shown in FIG. 6 may be carried out by lowering the forklift arms while propelling the forklift vehicle further in the forward direction. Upon fully inverting the trailer chassis, the frame may be locked in place by use of the locking pin as described above to prevent further rotation. The inverted trailer chassis may be lifted upward and moved to a desired location for stacking, or it may be placed on top of a partially completed stack. Unstacking and placement of trailer chassis right side up may be carried out by the use of the above described steps in reverse.

The above embodiment is provide for illustrative purposes only and is not to be understood as limiting the scope of the invention, which is limited only as indicated by the appended claims.

I claim:

1. Apparatus attachable to a vehicle having a pair of generally horizontally disposed, vertically movable lifting arms for grasping, lifting, and inverting trailer chassis comprising:

a pair of spaced apart support arms, each having at one end attachment means for removable engagement with an arm of said vehicle, and at an opposite end having inwardly facing support means defining a first axis of rotation generally transverse to said arms;

a rigid frame having a pair of opposite sides, a center of gravity, and a second axis passing through said center of gravity and said opposite sides, said rigid frame being positioned between said support arms and being supported by a respective support means at each of said opposite sides in longitudinal offset relation from said second axis; and means for clamping said frame to longitudinally extending members of a said trailer chassis whereby, upon lifting of said support arms by said lifting arms, said offset relation of said frame causes said frame and trailer to be rotated by gravity around said first axis, with said trailer chassis being rotated around a third axis parallel to its length as said trailer chassis is moved forward by said vehicle.

2. Apparatus as defined in claim 1 including means for locking said frame in a position generally co-planar with said support arms.

3. Apparatus as defined in claim 1 wherein said support means comprises a pair of pins, one each of which being secured by a pair of apertured plates extending outward from and connected to sides of said outer ends of said support arm.

4. Apparatus as defined in claim 3 wherein each of said pins includes an inwardly and axially extending portion, and wherein outwardly facing sides of said frame adjacent said support arms each include an apertured plate longitudinally offset from said second axis for receiving a said extending portion of a said pivot pin.

5. Apparatus as defined in claim 1 wherein said support arms are rigidly and directly connected by at least one cross member.

6. Apparatus as defined in claim 5 wherein said locking means comprises a pin slidably mounted to said cross member and disposed for movement toward and away from said frame, and openings in said frame alignable with and engageable by said pin, whereby when said pin is engaged with one of said openings said frame is locked in a starting position and when said pin is engaged in another of said openings said frame is locked in an inverted position.

7. Apparatus as defined in claim 6 wherein said means for clamping comprises a pair of spaced, fixed L-shaped members attached to one end of said frame and adapted to be hooked around a flange of a first trailer chassis beam, and a pair of spaced, movable members attached to an opposite end of said frame and defining notches for engaging a second trailer chassis beam, said movable members disposed to be slidable in a direction toward and away from the respective fixed L-shaped members so that the trailer chassis beams are thereby secured from movement.

8. Apparatus as defined in claim 7 including means for locking said spaced, movable members in engaged position.

9. Apparatus as defined in claim 8 wherein said means for locking said spaced, movable members comprises a spring biased pin in each said movable member, said pin disposed for being projected downward into an aperture in said frame.

10. The method of lifting and inverting around a longitudinal axis a trailer chassis having a pair of longitudinal chassis frame members which comprises:

providing an apparatus including a pair of horizontally disposed support arms, each of said arms being attached at one end to a lifting arm of a powered vehicle, with opposite ends of said support arms provided with coaxially disposed pins defining a first axis of rotation generally transverse to said support arms, a chassis-engaging rigid frame rotatably engaging said pins in offset relation for eccentric, free rotation from a center of gravity of said frame around said axis, and means for securing said frame to said chassis frame members;

moving said chassis-engaging frame into position underneath and transverse to a second axis longitudinal to said chassis;

securing said chassis-engaging frame to said chassis frame members;

raising said lifting arms whereby said chassis is pivoted around said first axis, and outer edges of members of said chassis come into contact with a ground surface by force of gravity; and propelling said powered vehicle forward as said lifting arms are lowered whereby said chassis is rotated to a fully inverted position.

11. A method as defined in claim 10 including the step of locking said chassis-engaging frame to restrain movement thereof with respect to said support arms upon completion of rotation.

* * * * *